US005311235A

United States Patent [19]

Piccinino, Jr. et al.

[11] Patent Number: 5,311,235

[45] Date of Patent: May 10, 1994

[54] DRIVING MECHANISM FOR A PHOTOGRAPHIC PROCESSING APPARATUS

[75] Inventors: Ralph L. Piccinino, Jr., Rush; David L. Patton, Webster; Roger E. Bartell, Rochester, all of N.Y.; Anthony Earle, London, England; John H. Rosenburgh, Hilton, N.Y.

[73] Assignee: Eastman Kodak Company, Rochester, N.Y.

[21] Appl. No.: 844,820

[22] Filed: Mar. 2, 1992

[51] Int. Cl.[5] ..... G03D 3/08

[52] U.S. Cl. ..... 354/320; 354/336

[58] Field of Search ..... 354/319-324; 134/64 R, 64 P, 122 P, 122 R; 226/170-172, 189

[56] References Cited

U.S. PATENT DOCUMENTS

| | | | |
|---|---|---|---|
| 3,261,278 | 7/1966 | Jiruska . | |
| 3,598,037 | 8/1971 | Houston, Sr. . | |
| 3,989,176 | 11/1976 | Hope et al. | 226/189 |
| 4,130,825 | 12/1978 | Fassano | 354/322 |
| 4,156,569 | 5/1979 | Fassano | 354/322 |
| 4,230,404 | 10/1980 | Huss | 354/321 |
| 4,422,748 | 12/1983 | Everett et al. | 354/322 X |
| 4,440,485 | 4/1984 | Maldonado et al. | 354/322 |
| 4,613,222 | 9/1986 | Takase et al. | 354/321 |
| 4,708,453 | 11/1987 | Fryda et al. | 354/320 |
| 4,745,423 | 5/1988 | Uchida | 354/320 |
| 4,763,152 | 8/1988 | Blackman | 354/321 |
| 4,775,873 | 10/1988 | Blackman et al. | 354/321 |
| 4,887,116 | 12/1989 | Uchiyama et al. | 354/320 |
| 4,937,607 | 6/1990 | Kulus et al. | 354/320 |

FOREIGN PATENT DOCUMENTS

| | | |
|---|---|---|
| 0222583 | 5/1987 | European Pat. Off. . |
| 3242810 | 5/1984 | Fed. Rep. of Germany . |

*Primary Examiner*—D. Rutledge

*Attorney, Agent, or Firm*—Ronald Reichman

[57] ABSTRACT

An apparatus for processing photosensitive materials, which comprises: a tank through which a processing solution is to be pumped; a rack having integral means to facilitate its insertion and removal from the tank, the rack and the tank are relatively dimensioned so that a small volume for holding processing solution and photosensitive material is formed between the rack and the tank; means for circulating the processing solution through the small volume; a first plurality of rollers for moving the photosensitive material into or out of the small volume; a second plurality of rollers connected to the rack; a third plurality of rollers connected to the tank, wherein the second and third plurality of rollers move the photosensitive material through the small volume; means for driving the second plurality of rollers; and means for preventing processing solution from flowing between the driving means and the second plurality of rollers to reduce the space that would otherwise be filled by the processing solution.

12 Claims, 10 Drawing Sheets

DRIVING MECHANISM FOR A PHOTOGRAPHIC PROCESSING APPARATUS

CROSS REFERENCE TO RELATED APPLICATIONS

Reference is made to commonly assigned copending patent applications: U.S. Pat. No. 5,179,404 entitle "ANTI-WEB ADHERING CONTOUR SURFACE FOR A PHOTOGRAPHIC PROCESSING APPARATUS" filed herewith in the names of Roger E. Bartell, Ralph L. Piccinino, Jr., John H. Rosenburgh, Anthony Earle, and David L. Patton; Ser. No. 844,815 entitled "A RACK AND A TANK FOR A PHOTOGRAPHIC PROCESSING APPARATUS" filed herewith in the names of David L. Patton, Roger E. Bartell, John H. Rosenburgh and Ralph L. Piccinino, Jr., Ser. No. 844,815 entitled "A SLOT IMPINGEMENT FOR A PHOTOGRAPHIC PROCESSING APPARATUS" filed herewith in the names of John Rosenburgh, David L. Patton, Ralph L. Piccinino, Jr., and Anthony Earle; and Ser. No. 844,806 entitled "RECIRCULATION, REPLENISHMENT, REFRESH, RECHARGE AND BACKFLUSH FOR A PHOTOGRAPHIC PROCESSING APPARATUS" filed herewith in the names of Roger E. Bartell, David L. Patton, John Rosenburgh, and Ralph L. Piccinino, Jr.

BACKGROUND OF THE INVENTION

1. Field of the Invention

The invention relates to the field of photography, and particularly to a photosensitive material processing apparatus.

2. Description of the Prior Art

The processing of photographic film involves a series of steps such as developing, bleaching, fixing, washing, and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatus, i.e., large photofinishing apparatus and microlabs. A large photofinishing apparatus utilizes tanks that contain approximately 100 litres of each processing solution. A small photofinishing apparatus or microlab utilizes tanks that may contain less than 10 litres of processing solution.

The chemicals contained in the photographic solution: cost money to purchase; change in activity and leach out or season during the photographic process; and after the chemicals are used the chemicals must be disposed of in an environmentally safe manner. Thus, it is important in all sizes of photofinishing apparatus to reduce the volume of processing solution. The prior art suggests various types of replenishing systems that add or subtract specific chemicals to the photographic solution to maintain a consistency of photographic characteristics in the material developed. It is possible to maintain reasonable consistency of photographic characteristics only for a certain period of replenishment. After a photographic solution has been used a given number of times, the solution is discarded and a new photographic solution is added to the tank.

Activity degradation due to instability of the chemistry, or chemical contamination, after the components of the photographic solution are mixed together causes one to discard the photographic solution in smaller volume tanks more frequently than larger volume tanks. Some of the steps in the photographic process utilize photographic solutions that contain chemicals that are unstable, i.e., they have a short process life. Thus, photographic solutions in tanks that contain unstable chemicals are discarded more frequently than photographic solutions in tanks that contain stable chemicals.

The prior art realized that if the volume of the various tanks contained within various sizes of photographic processing apparatus were reduced the same amount of film or photographic paper may be processed, while reducing the volume of photographic solution that was used and subsequently discarded. One of the problems encountered by the prior art in using smaller volume tanks was that the space was limited so that there was not sufficient space available to allow the drives utilized in the prior art to move the film and/or paper.

One of the techniques utilized by the small volume processing tank prior art to reduce the volume of processing solution was to place the drive mechanisms including idlers, tensioners, and other drive components on the outside of the tank. A disadvantage of the above technique was that the drive mechanism had to pass through the walls of the tank, breaking the fluid retaining integrity of the tank. Thus, the drive mechanism required seals to prevent processing solution from leaking out of the tanks. The seals increased the cost of the drive mechanism, required additional maintenance and reduced the reliability of the drive mechanisms.

Another technique utilized by the small volume processing tank prior art was to place the drive mechanisms on the inside of the processing tank. The major disadvantage of the above technique was that the volume of processing solution was increased in order to fill the voids created by placing the drive mechanism on the inside of the tank.

SUMMARY OF THE INVENTION

This invention overcomes the disadvantages of the prior art by providing a drive mechanism that does not significantly increase the volume of processing solution in small volume tanks. The drive mechanism may be affixed to the walls of a rack and/or tank and the voids between the components of the drive mechanism are filled in with a material that reduces the space that would otherwise have to be filled with processing solution.

When the components of the drive mechanism were filled often times portions of the chains or belts of the drive mechanism would interfere with portions of the remaining drive mechanism. This problem was solved by utilizing a drive separator to keep portions of the chain or belt from contacting portions of the remaining drive mechanism.

The foregoing is accomplished by providing an apparatus for processing photosensitive materials, which comprises: a tank through which a processing solution is to be pumped; a rack having integral means to facilitate its insertion and removal from the tank, the rack and the tank are relatively dimensioned so that a small volume for holding processing solution and photosensitive material is formed between the rack and the tank; means for circulating the processing solution through the small volume; a first plurality of rollers for moving the photosensitive material into or out of the small volume; a second plurality of rollers connected to the rack; a third plurality of rollers connected to the tank, wherein the second and third plurality of rollers move the photosensitive material through the small volume; means for driving the second plurality of rollers; and means for preventing processing solution from flowing between the driving means and the second plurality of rollers to reduce the space that would otherwise be filled by the processing solution.

DESCRIPTION OF THE PREFERRED EMBODIMENT

Figure 1:
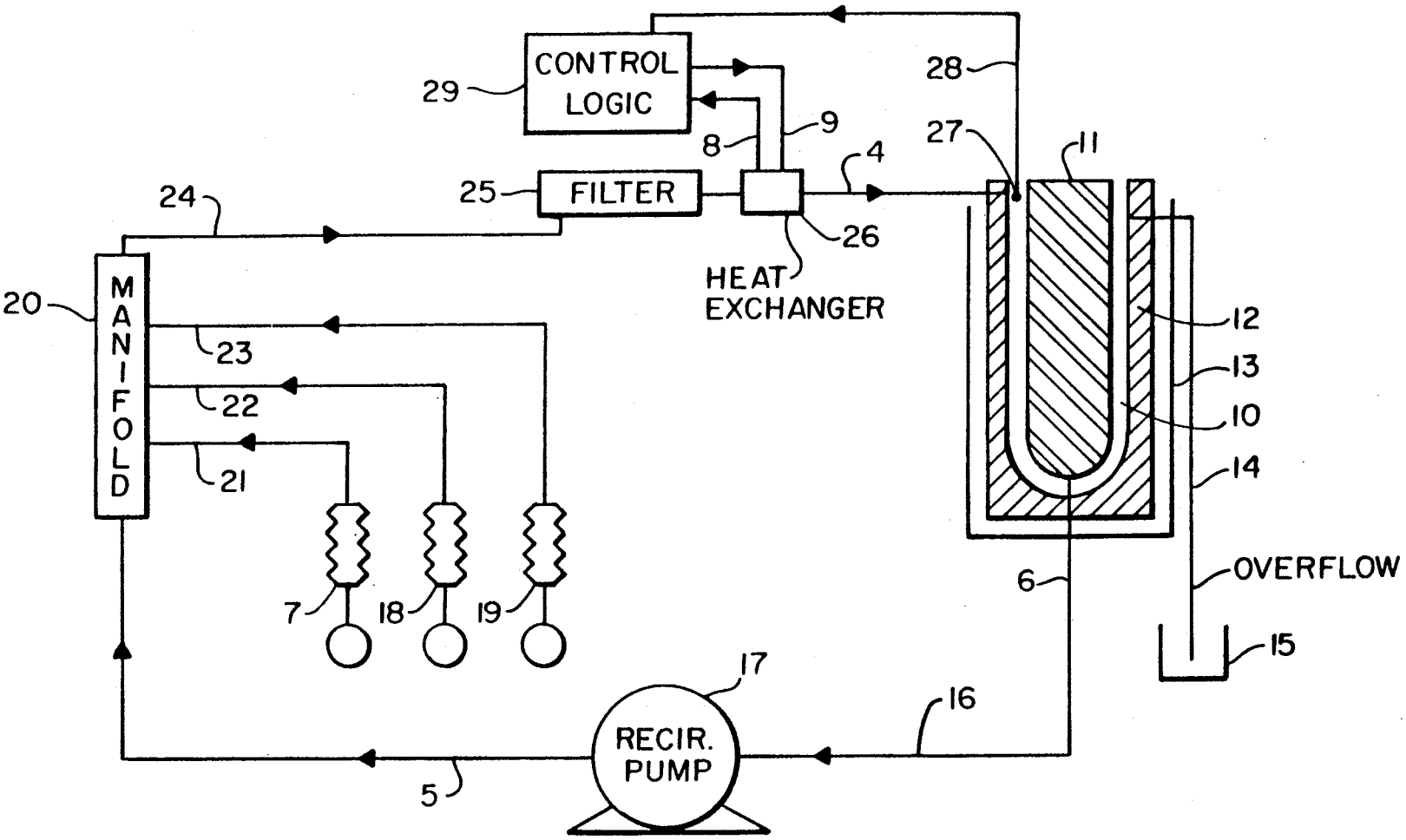
FIG. 1 is a schematic drawing of the apparatus of this invention.

Referring now to the drawings in detail, and more particularly to FIG. 1, the reference character 11 represents a rack, which may be easily inserted and removed from tank 12. Rack 11 and tank 12 form a low volume photosensitive material processing vessel 13.

When rack 11 is inserted in tank 12, a space is formed. Rack 11 and tank 12 are designed in a manner to minimize the volume of space 10. The outlet 6 of vessel 13 is connected to recirculating pump 17 via conduit 16. Recirculating pump 17 is connected to manifold 20 via conduit 5 and manifold 20 is connected to filter 25 via conduit 24. Filter 25 is connected to heat exchanger 26 and heat exchanger 26 is connected to control logic 29 via wire 9. Control logic 29 is connected to heat exchanger 26 via wire 8 and sensor 27 is connected to control logic 29 via wire 28. Metering pumps 7, 18 and 19 are respectively connected to manifold 20 via conduits 21, 22 and 23.

The photographic processing chemicals that comprise the photographic solution are placed in metering pumps 7, 18 and 19. Pumps 7, 18 and 19 are used to place the correct amount of chemicals in manifold 20. Manifold 20 introduces the photographic processing solution into conduit 24.

The photographic processing solution flows into filter 25 via conduit 24. Filter 25 removes particulate matter and dirt that may be contained in the photographic processing solution. After the photographic processing solution has been filtered, the solution enters heat exchanger 26.

Sensor 27 senses the temperature of the solution and transmits the temperature of the solution to control logic 29 via wire 28. For example, control logic 29 is the series CN 310 solid state temperature controller manufactured by Omega Engineering, Inc. of 1 Omega Drive, Stamford, Conn. 06907. Logic 29 compares the solution temperature sensed by sensor 27 and the temperature that exchanger 26 transmitted to logic 29 via wire 8. Logic 29 will inform exchanger 26, via wire 9 to add or remove heat from the solution. Thus, logic 29 and heat exchanger 26 modify the temperature of the solution and maintain the solution temperature at the desired level.

At this point the solution enters vessel 13 via inlet 4. When vessel 13 contains too much solution the excess solution will be removed by drain 14 and flow into reservoir 15. The remaining solution will circulate through space 10 and reach outlet line 6. Thereupon, the solution will pass from outlet line 6 to conduit line 16 to recirculation pump 17. The photographic solution contained in the apparatus of this invention, when exposed to the photosensitive material, will reach a seasoned state more rapidly than prior art systems, because the volume of the photographic processing solution is less.

Figure 2:
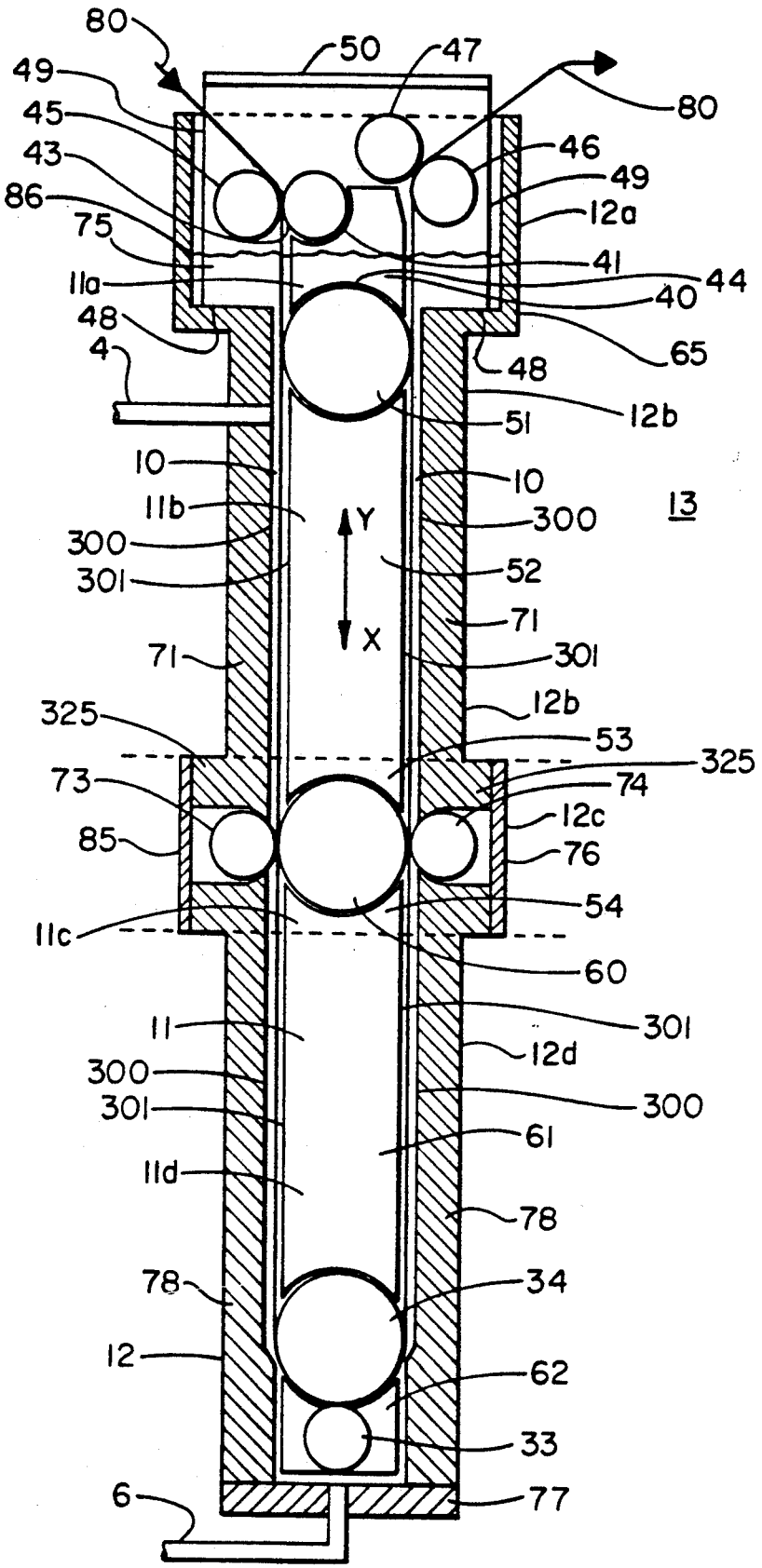
FIG. 2 is a schematic drawing showing rack 11 and tank 12 of FIG. 1 in greater detail.

FIG. 2 is a schematic diagram showing rack 11 positioned within tank 12. Handle section **11*a* of rack 11 includes a panel 40. Panel 40 has a cut-out section 41 which allows driven roller 43 of rack section 11*a* to rotate in the vicinity of panel 40. Panel 40 also has a cut-out section 44 which allows driving roller 51 of rack section 11*b* to rotate in the vicinity of panel 40. Driving roller 45 engages roller 43. Driving roller 46 drives driven roller 47. Rollers 46 and 47 are attached to section 11*a*. Bottom plate 48 is connected to panel 40 and side plates 49. Handle 50 is connected to side plates 49 so that an individual may be able to grasp handle 50 and move rack 11 in the direction indicated by arrow X, thereby inserting rack 11 into tank 12. This is the position shown in FIG. 2. Handle 50 may also be grasped and moved in the direction indicated by arrow Y to remove rack 11 from tank 12**.

Top section **11*b* of rack 11 includes panel 52 and driving rollers 51 and center section 11*c* of rack 11 includes panels 53 and 54 and driving roller 60. Bottom section 11*d* of rack 11 includes panels 61 and 62, driving roller 34 and driven roller 33**.

Tank section **12*a* includes a housing section 65. Tank section 12*b* includes sides 71. Tank section 12*c* includes driven rollers 73 and 74 and sides 325. Roller 73 is connected to plate 85 and driven roller 74 is connected to plate 76. Plates 85 and 76 are connected to side 325. Bottom section 12*d* of tank 12 includes bottom panel 77 and sides 78. Outlet conduit 6 passes through panel 77 and inlet conduit 4 passes through side 71**.

Photosensitive material 80 may be a continuous web or cut sheets of film or photographic paper. The emulsion side of material 80 may face either rack 11 or tank 12. Material 80 passes in space between rollers 45 and 43, roller 51 and side 71, rollers 73 and 60, rollers 34 and 33, rollers 60 and 74, roller 51 and side 71 and between rollers 46 and 47. Photographic processing solution 75 reaches a level 86 within tank 12. Photographic solution 75 will be contained between level 86, space 10 and photosensitive material 80. Thus, a small volume of photographic solution 75 will be on both sides of photosensitive material 80 between rack 11 and tank 12.

Rack 11 and tank 12 respectively comprise: handle sections 11*a* and 12*a*; top sections 11*b* and 12*b*; center sections 11*c* and 12*c*; and bottom sections 11*d* and 12*d*.

Tank 12 and rack 11 respectively have textured surfaces 300 and 301.

The length of rack 11 and tank 12 ma be adjusted for different processing steps in the photographic process. If a vessel shorter than vessel 13 of FIG. 2 is required, center rack section 11*c* and center tank section 12*c* may be respectively deleted from rack 11 and tank 12. If a longer vessel than vessel 13 of FIG. 2 is required, one or more top sections 11*b* and 12*b* and one or more center sections 11*c* and 12*c* may be respectively connected between present sections 11*c* and 12*c* and present sections 11*d* and 12*d*.

Figure 3:
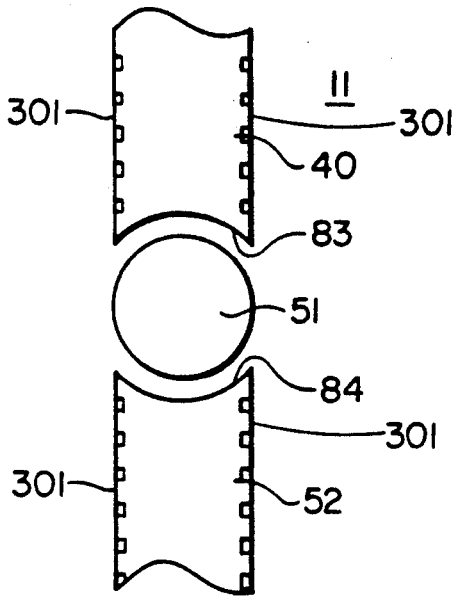
FIG. 3 is a drawing of a side view of driving roller 51 of FIG. 2.

FIG. 3 is a side view of roller 51 and textured surface 301 of rack 11. Rollers 60 and 34 are connected in a manner similar to the connection of roller 51 of FIG. 3.

Panels 40 and 52 of rack 11 respectively have curved portions 83 and 84. Portions 83 and 84 are shaped so that they will match the curvature of the outer surface of roller 51 and minimize the volume of solution 75 that will be contained between roller 51 and portions 83 and 84. Thus, the least amount of solution 75 is used to fill the voids around roller 51.

Figure 4:
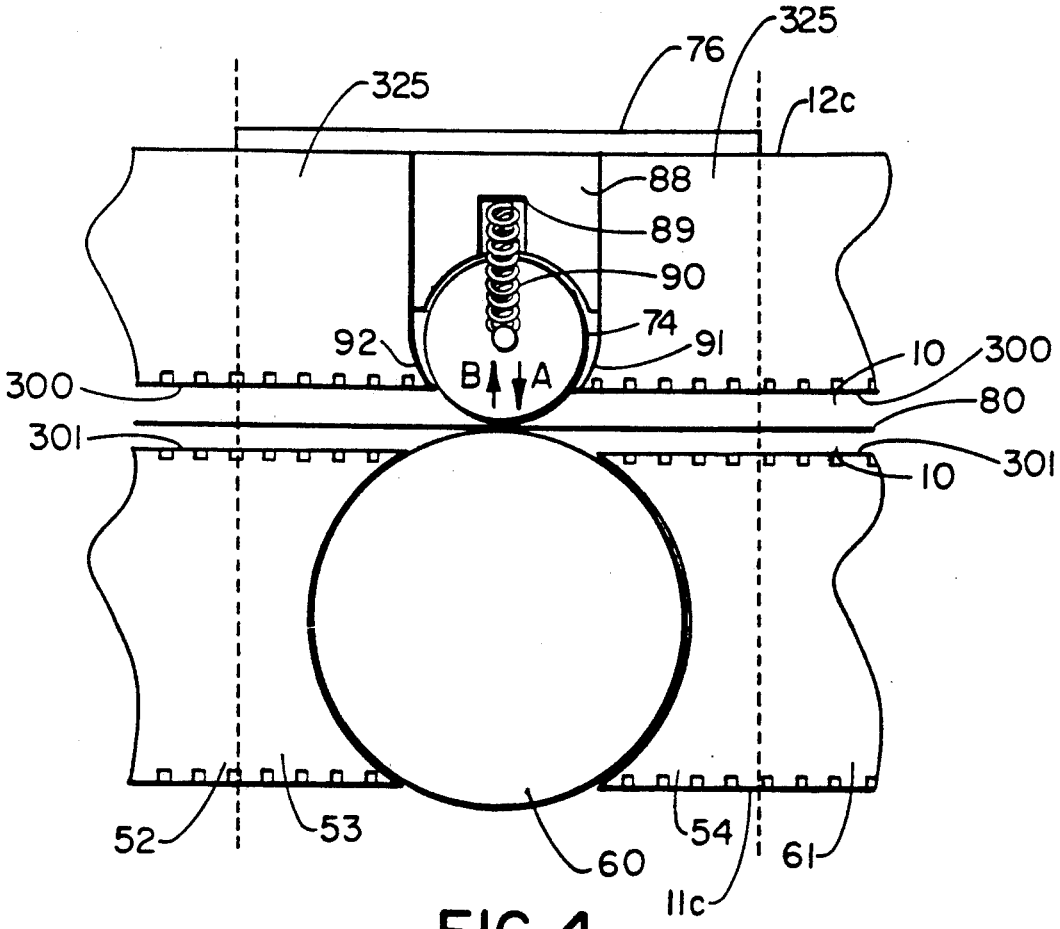
FIG. 4 is a drawing of a side view of driven roller 74 of FIG. 2.

FIG. 4 is a side view of roller 74 and roller 60 respectively of tank section 12*c* and rack section 11*c* of FIG. 2. Panel 53 and panel 54 with textured surface 301 are shaped so that they will match the curvature of the outer surface of roller 60 and minimize the volume of solution 75 that will be contained between the shaped portions of panels 53 and 54 and roller 60. Panel 52 with textured surface 301 butts against panel 53 and panel 61 with textured surface 301 butts against panel 54. Roller 73 of FIG. 2 is connected in the same manner as roller 74. Retainer 88 has a notch 89. One end of spring 90 is connected to notch 89 and the other end of spring 90 is connected to the hub of roller 74. One end of plate 91 is connected to retainer 88 and the other end of plate 91 is connected to textured surface 300. One end of plate 92 is connected to retainer 88 and the other end of plate 92 is connected to textured surface 300. Plates 91 and 92 are connected to retainer 88 and surface 300 in a manner to minimize the amount of surface contact roller 74 has with space 10. Retainer 88 is connected to back plate 76 by any known fastening means, i.e., bolts, screws, etc. Plate 76 is connected to side 325 of tank section 12*c* to minimize the volume of solution 75 that exists in the voids between the above surfaces, plates, rollers and tank. Photosensitive material 80 passes between rollers 60 and 74 so that driving roller 60 may move photosensitive material 80 in space 10 between textured surfaces 300 and 301. Roller 74 is spring loaded towards space 10 so that roller 74 may be compressed out of the way when rack 11 is inserted in tank 12.

Figure 4A:
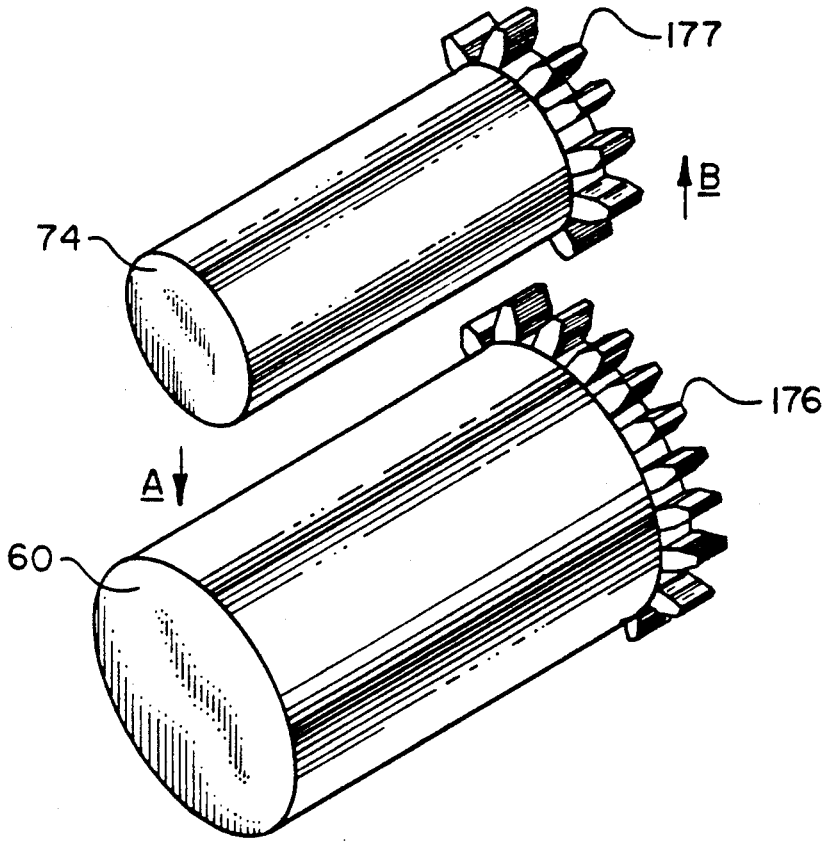
FIG. 4A is a drawing showing the gears of rollers 60 and 74.

FIG. 4A depicts gears 176 and 177 attached respectively to rollers 60 and 74 in such a manner that when roller 74 engages the surface of roller 60 gear 177 engages gear 176 so that gear 176 drives gear 177. When rack 11 is properly seated in tank 12, roller 74 will move in the direction shown by arrow A until it engages driving roller 60 and gears 176 and 177 will mesh. When rack 11 is removed from tank 12 roller 74 will move in the direction shown by arrow B compressing out of the way until rack 11 is removed from tank 12. At this juncture roller 74 will move in the direction shown by arrow A.

Figure 5:
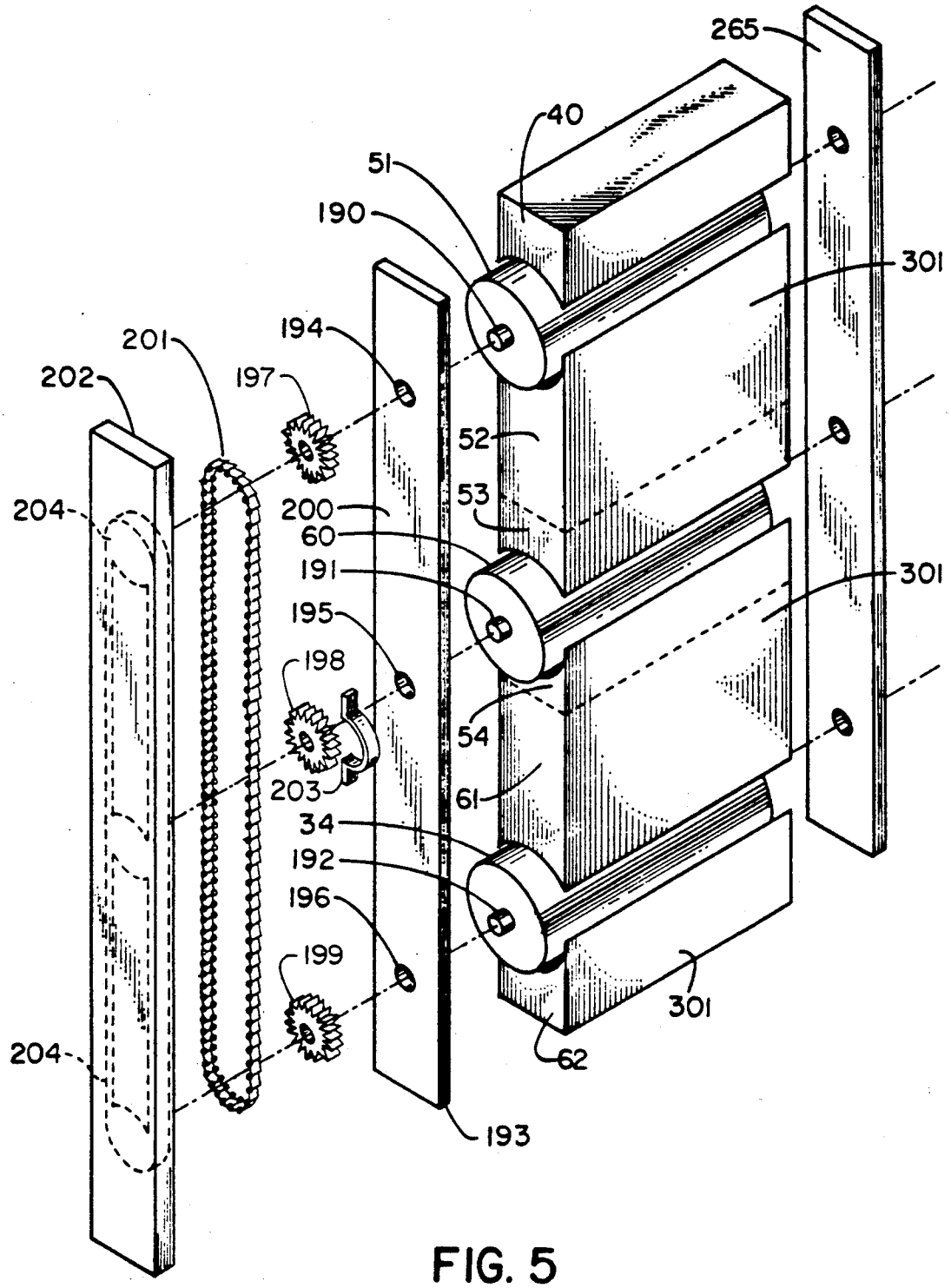
FIG. 5 is an exploded perspective drawing of the drive mechanism of rack 11 being driven by a belt or chain.

FIG. 5 is an exploded perspective drawing of a mechanism that drives rollers 51, 60 and 34 of FIG. 2. Panel 40 and panel 52 with textured surface 301 butt against roller 51 and panels 40 and 52 allow roller 51 to rotate on shaft 190 in the vicinity of panels 40 and 52. Panel 53 and panel 54 with textured surface 301 butt against roller 60 to allow roller 60 to rotate on shaft 191 in the vicinity of panels 53 and 54. Panel 61 and panel 62 with textured surface 301 butt against roller 34 to allow roller 34 to rotate on shaft 192 in the vicinity of panels 61 and 62. Side plate 193 is connected to panels 40, 52, 53, 54, 61 and 62 in such a manner that shafts 190. 191 and 192 will respectively pass through orifices 194, 195 and 196 of plate 193. Sprockets 197, 198 and 199 will respectively be connected to shafts 190, 191 and 192 in a manner that when chain 201 moves, rollers 51, 60 and 34 will rotate. Side plate 265 is connected to panels 40, 52, 53, 54, 61 and 62. Belts and pulleys or other driving components may be used in place of chain 201 and sprockets 197, 198 and 199.

Drive separator 203 is connected to fluid displacement plate 202. The manner in which separator 203 is connected to plate 202 will be more fully set forth in the description of FIG. 6. Displacement plate 202 is essentially a solid plate with a cut out region 204. Region 204 supplies space for sprockets 197, 198 and 199, chain 201, drive separator 203 and drive engager 210 (shown in FIG. 7) in plate 202 so that when plate 202 is connected to plate 193 by any known fastening means, i.e., bolts, screws, etc. processing solution 75 will not be able to flow or reside in any of the solid areas of plate 202. Thus, a smaller volume of processing solution 75 may be utilized.

Figure 6:
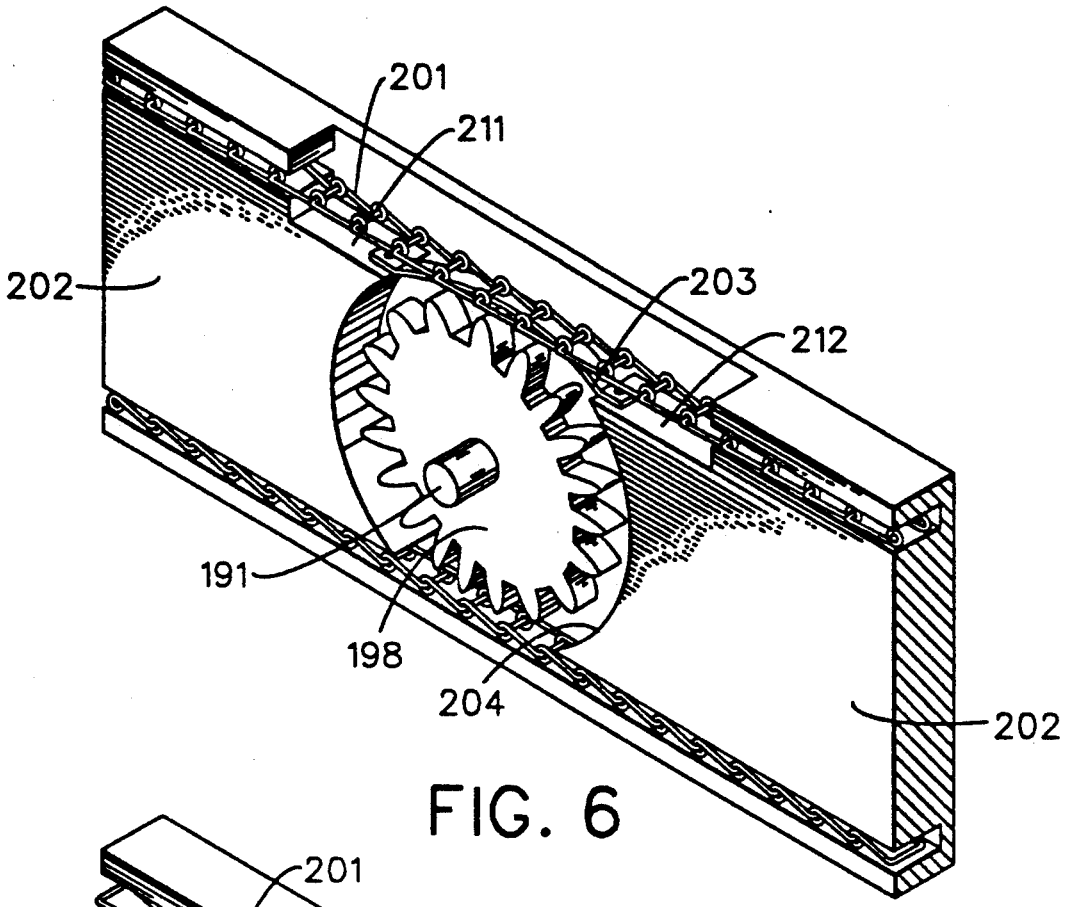
FIG. 6 is a perspective drawing showing the drive separator of FIG. 5 in greater detail.

FIG. 6 is a perspective drawing showing drive separator 203 of FIG. 5 connected to the top of plate 202 in the vicinity of sprocket 198. Separator 203 is connected to cut out regions 211 and 212 of plate 202 by any known fastening means, i.e., screws, bolts, rivets, etc. Chain 201, sprocket 198, and separator 203 are in region 204 of plate 202 and separator 203 is used to keep portions of chain 201 separated so that they will not interfere with other portions of chain 201 and sprocket 198, which is attached to shaft 191.

Figure 7:
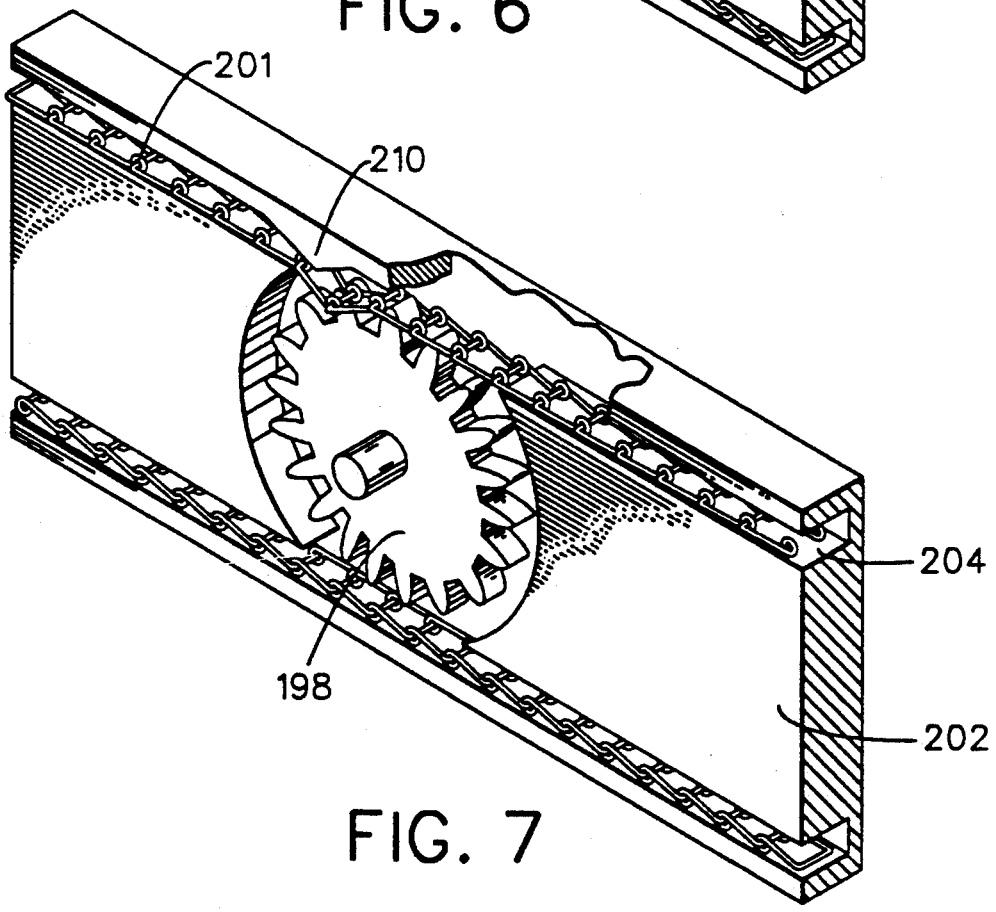
FIG. 7 is a perspective drawing showing drive engager 210 which is connected to a portion of fluid displacement plate 203.

FIG. 7 is a perspective drawing showing drive engager 210 affixed to the bottom of plate 202 in the vicinity of sprocket 198. Drive engager 210 is connected to plate 202 by any known fastening means, i.e., screws, bolts, rivets, etc. Chain 201, sprocket 198, separator 203 and engager 210 are in region 204 of plate 202 and engager 210 is used to keep chain 201 in positive engagement with sprocket 198, which is attached to shaft 191.

Figure 8:
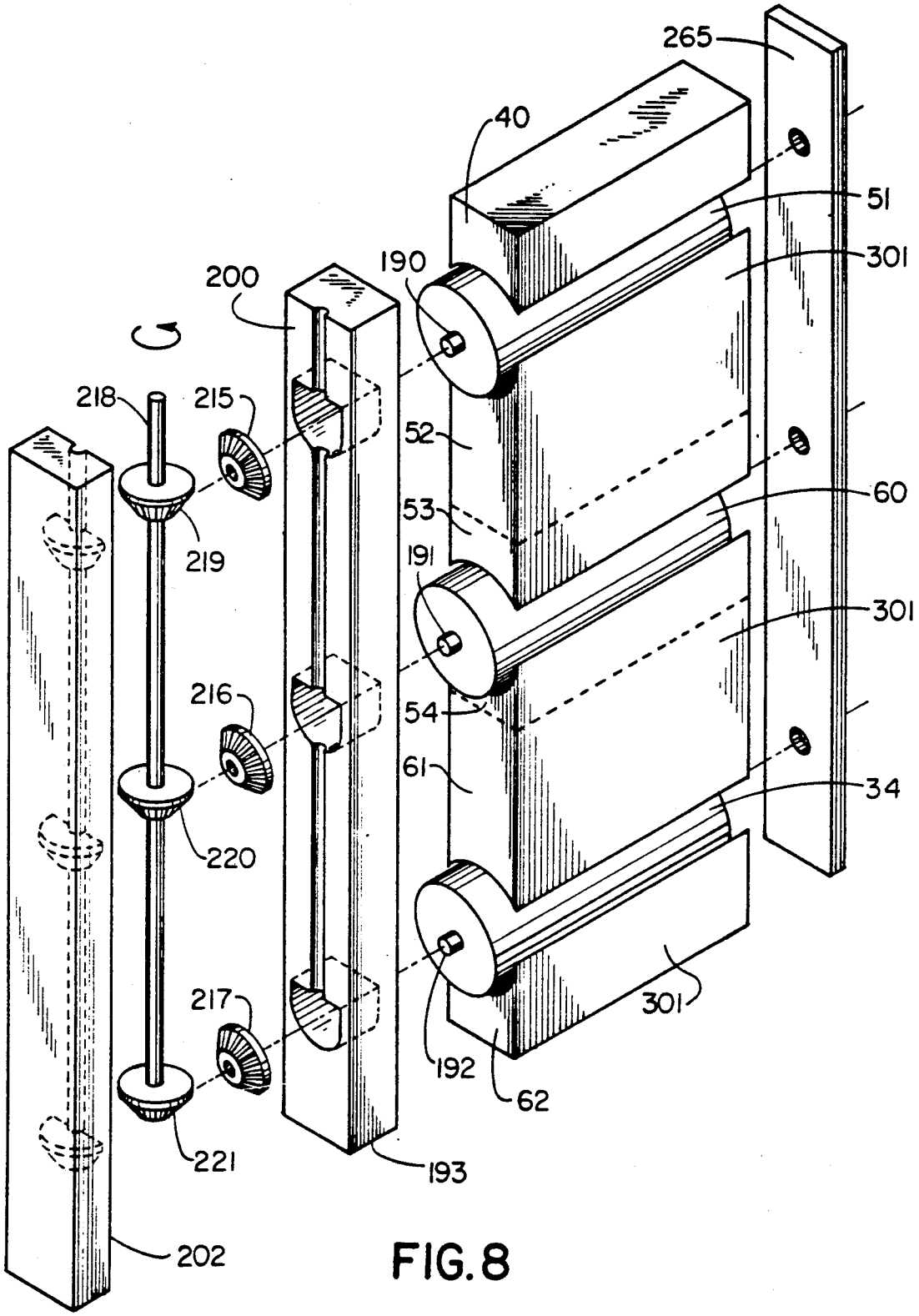
FIG. 8 is an exploded perspective drawing of the drive mechanism of rack 11 being driven by a plurality of gears.

FIG. 8 is an exploded perspective drawing of a mechanism that drives rollers 51, 60 and 34 of FIG. 2. Panel 40 and panel 52 with textured surface 301 butt against roller 51 and panels 40 and 52 permit roller 51 to rotate on shaft 190 in the vicinity of panels 40 and 52. Panel 53 and panel 54 with textured surface 301 butt against roller 60 to allow roller 60 to rotate on shaft 191 in the vicinity of panels 53 and 54. Panel 61 and panel 62 with textured surface 301 butt against roller 34 to allow roller 34 to rotate on shaft 192 in the vicinity of panels 61 and 62. Side plate 193 is connected to panels 40, 52, 53, 54, 61 and 62 in such a manner that shafts 190, 191 and 192 will respectively pass through orifices 194, 195 and 196 of plate 193. Bevel gears 215, 216 and 217 will respectively be connected to shafts 190, 191 and 192 in a manner that bevel gears 215, 216 and 217 will be on side 200 of plate 193. Shaft 218 will engage bevel gears 219, 220 and 221 and gears 219, 220 and 221 will respectively engage gears 215, 216 and 217 so that when shaft 218 rotates, rollers 51, 60 and 34 will rotate. Side plate 265 is connected to panels 40, 52, 53, 54, 61 and 62.

Figure 9:
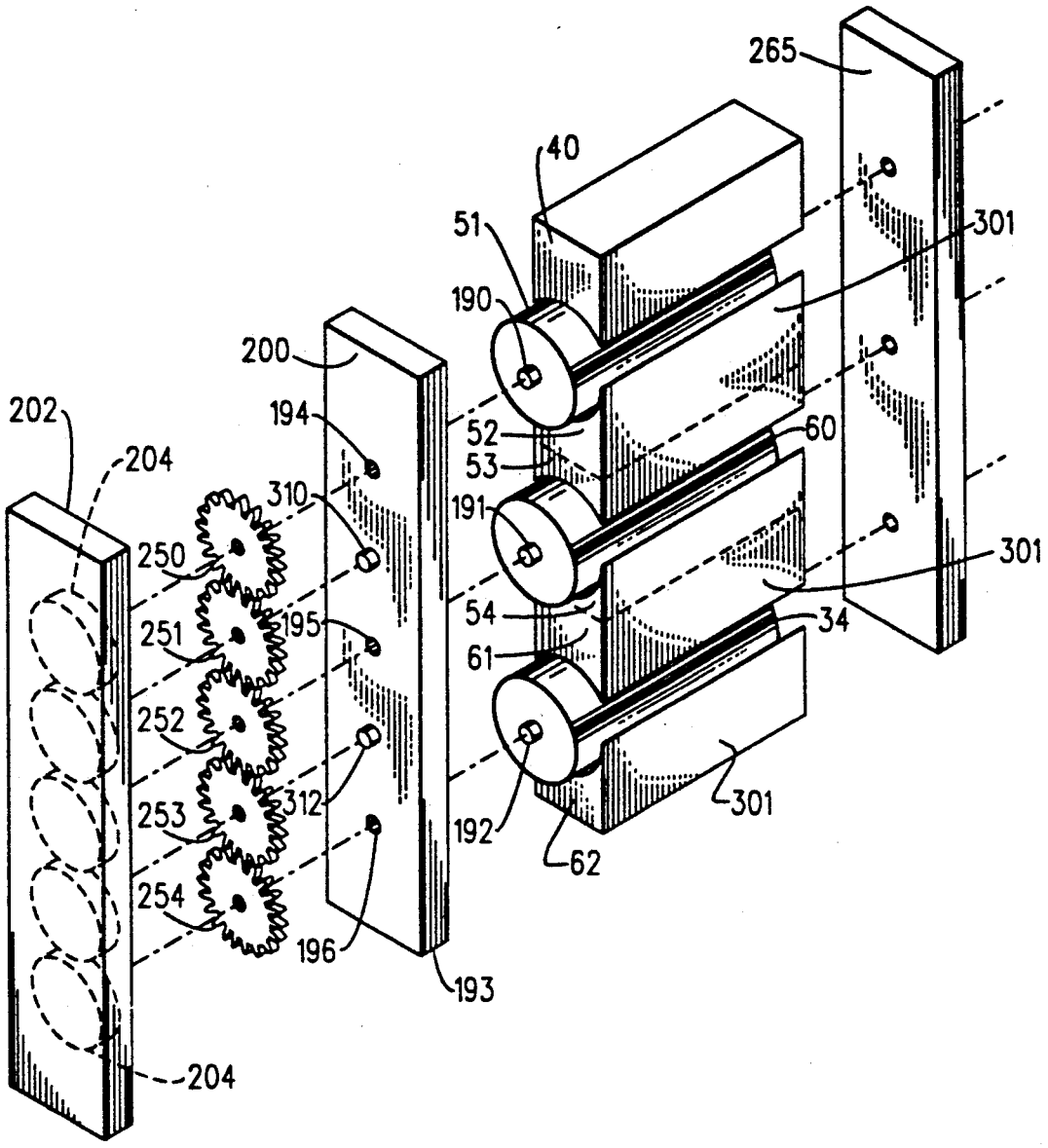
FIG. 9 is an exploded perspective drawing of the drive mechanism of rack 11 being driven by a plurality of interconnecting gears.

FIG. 9 is an exploded perspective drawing of a mechanism that drives rollers 51, 60 and 34 of FIG. 2. Panel 40 and panel 52 with textured surface 301 butt against roller 51 and panels 40 and 52 permit roller 51 to rotate on shaft 190 in the vicinity of panels 40 and 52. Panel 53 and panel 54 with textured surface 301 butt against roller 60 to allow roller 60 to rotate on shaft 192 in the vicinity of panels 53 and 54. Panel 61 and panel 62 with textured surface 301 butt against roller 34 to allow roller 34 to rotate on shaft 192 in the vicinity of panels 61 and 62. Side plate 193 is connected to panels 40, 52, 53, 54, 61 and 62 in such a manner that shafts 190, 191 and 192 will respectively pass through orifices 194, 195 and 196 of plate 193. Side plate 265 is connected to panels 40, 52, 53, 54, 61 and 62. A plurality of gears are interconnected so that each individual gear will engage the adjacent gear, i.e., gear 250 engages gear 251, gear 251 engages gear 252, gear 252 engages gear 253, and gear 253 engages gear 254. Gears 250–254 will be on side 200 of plate 193. Shaft 190 will be connected to gear 250, shaft 191 will be connected to gear 252, and shaft 192 will be connected to gear 254 so that when gears 250, 252 and 254 move, rollers 51, 60 and 34 will rotate. Gears 251 and 253 rotate on shafts 310 and 312 respectively.

Figure 10:
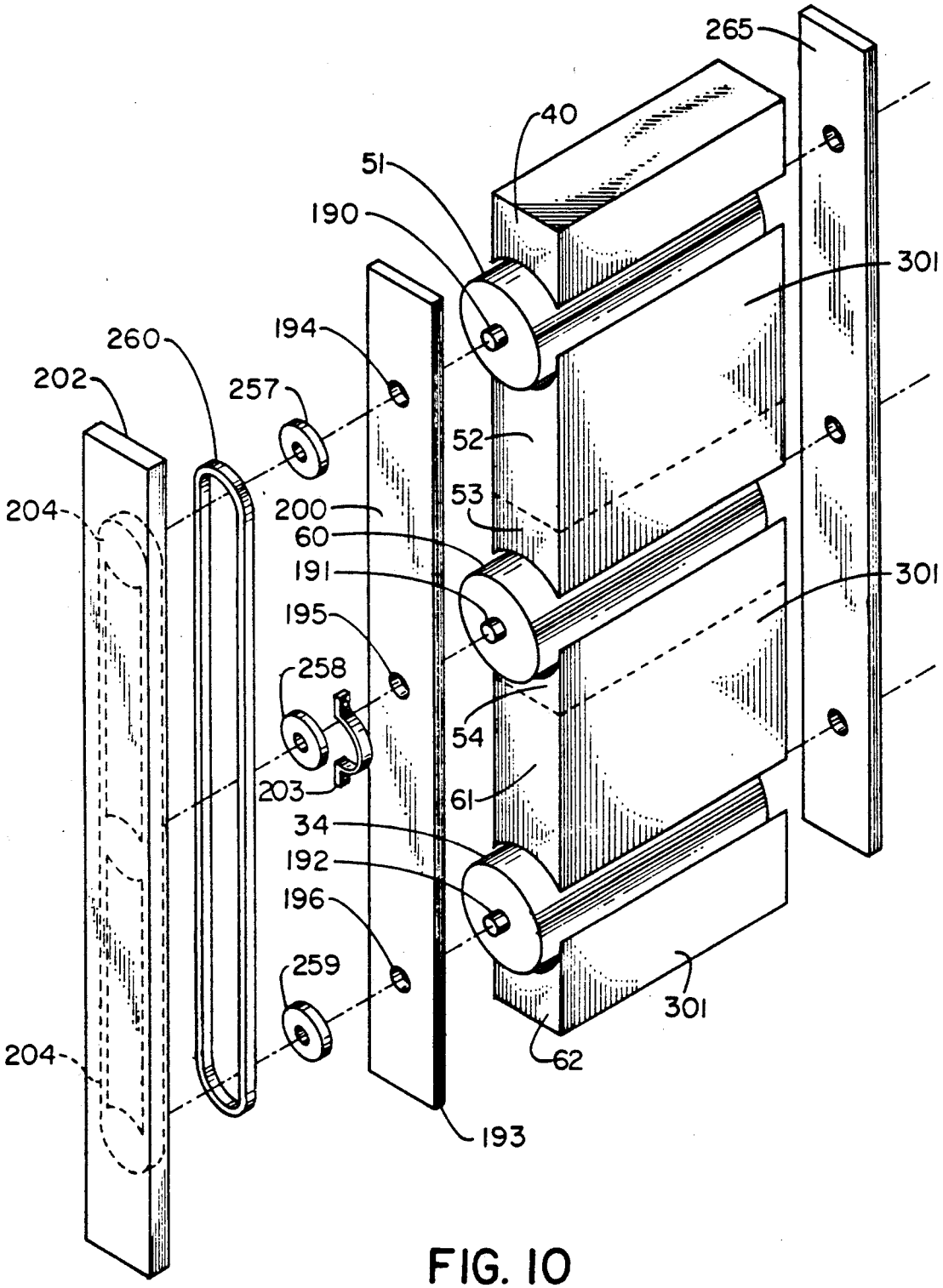
FIG. 10 is an exploded perspective drawing of the drive mechanism of rack 11 being driven by a plurality of pulleys.

FIG. 10 is an exploded perspective drawing of a mechanism that drives rollers 51, 60 and 34 of FIG. 2. Panel 40 and panel 52 with textured surface 301 butt against roller 51 and panels 40 and 52 allow roller 51 to rotate on shaft 190 in the vicinity of panels 40 and 52. Panel 53 and panel 54 with textured surface 301 butt against roller 60 to allow roller 60 to rotate on shaft 191 in the vicinity of panels 53 and 54. Panel 61 and panel 62 with textured surface 301 butt against roller 34 to allow roller 34 to rotate on shaft 192 in the vicinity of panels 61 and 62. Side plate 193 is connected to panels 40, 52, 53, 54, 61 and 62 in such a manner that shafts 190, 191 and 192 will respectively pass through orifices 194, 195 and 196 of plate 193. Pulleys 257, 258 and 259 will respectively be connected to shafts 190, 191 and 192 in a manner that when belt 260 moves, rollers 51, 60 and 34 will rotate. Side plate 265 is connected to panels 40, 52, 53, 54, 61 and 62.

Drive separator 203 is connected to fluid displacement plate 202. The manner in which separator 203 is connected to plate 202 is set forth in the description of FIG. 6. Displacement plate 203 is essentially a solid plate with a cut out region 204. Region 204 supplies space for pulleys 257, 258 and 259, belt 260, drive separator 203 and drive engager 210 (shown in FIG. 7) in plate 202 so that when plate 202 is connected to plate 193 by any known fastening means, i.e., bolts, screws, etc. processing solution 75 will not be able to flow or reside in any of the solid areas of plate 202. Thus, a smaller volume of processing solution 75 may be utilized.

Figure 11:
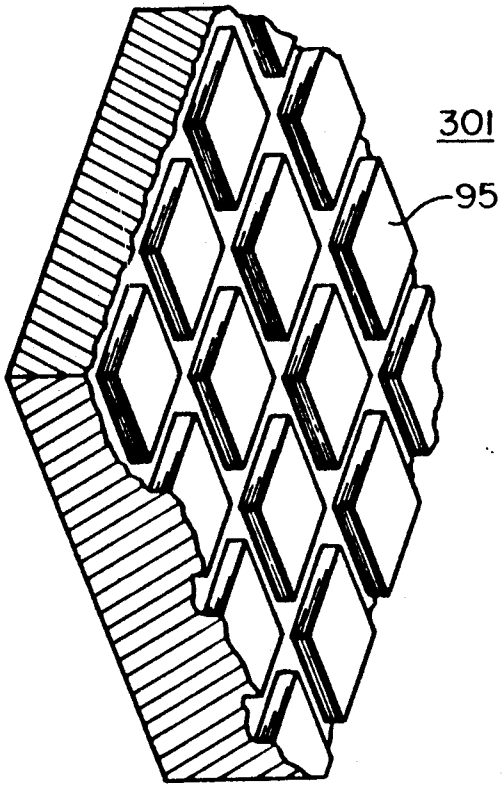
FIG. 11 is a perspective drawing of textured fluid bearing surface 301 which is affixed to rack 11 of FIG. 2.

FIG. 11 is a perspective drawing of textured fluid-bearing surface 301 which is affixed to rack 11 of FIG. 2. Textured surface 301 is textured by any known process, e.g., knurling, molded, EDM electro-discharged machined or applied. Knurls 95 are shown on surface 301. The texturing improves the flow of solution 75 between photosenitive material 80 and rack 11. This yields a bearing of fluid aiding photosensitive material transport through the rack arrangement. It also allows for improved circulation of solution 75 and makes it easier for particulate matter to escape direct and damaging contact with photosensitive material 80. Textured surface 301 provides space between rack 11 and space 10 to prevent particulate matter from scratching, abrading or pressure sensitizing photosensitive material 80.

Figure 12:
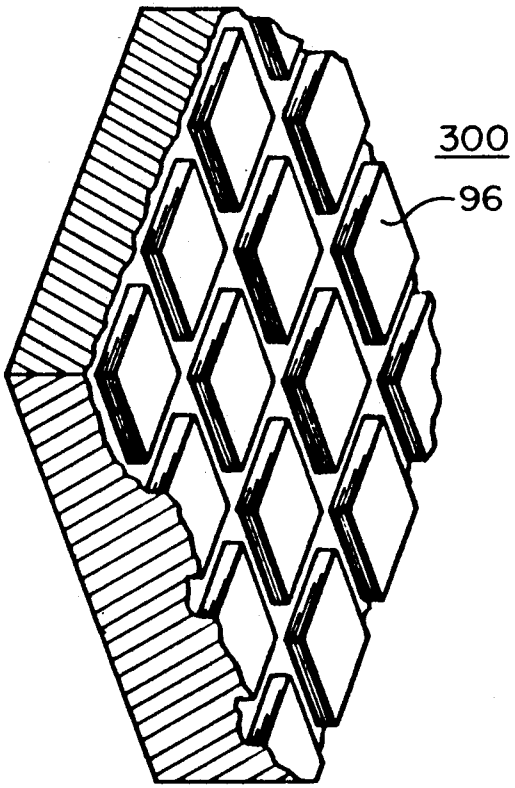
FIG. 12 is a perspective drawing of textured fluid bearing surface 300 which is affixed to tank 12 of FIG. 2.

FIG. 12 is a perspective drawing of textured fluid bearing surface 300 of tank 12. Textured surface 300 is textured by any known process, e.g., knurling, molded, EDM electro-discharged machined or applied. Knurls 96 are shown on surface 300. Texturing improves the flow of solution 75 between photosensitive material 80 and tank 12. This yields a bearing of fluid aiding photosensitive material transport through tank 12. It also allows for improved circulation of solution 75 and makes it easier for particulate matter to escape direct and damaging contact with photosensitive material 80. Textured surface 300 provides space between tank 12 and space 10 to prevent particulate matter from scratching, abrading or pressure sensitizing photosensitive material 80.

The above specification describes a new and improved apparatus for processing photosensitive materials. It is realized that the above description may indicate to those skilled in the art additional ways in which the principles of this invention may be used without departing from the spirit. It is, therefore, intended that this invention be limited only by the scope of the appended claims.

What is claimed is:

1. An apparatus for processing photosensitive materials, which comprises:

a tank through which a processing solution is pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume;

a first plurality of rollers for moving the photosensitive material into or out of the small volume;

a second plurality of rollers connected to said rack;

a third plurality of rollers connected to said tank, wherein said second and third plurality of rollers move the photosensitive material through the small volume;

a plurality of sprockets which are each individually linked to one of said second plurality of rollers;

a chain linked to each of said sprockets to drive each of said second plurality of rollers; and means for preventing processing solution from flowing between said sprockets, said chain and said second plurality of rollers to reduce the space that would otherwise be filled by the processing solution.

2. The apparatus claimed in claim 1, further including a drive engager positioned in the vicinity of said chain so that said chain will positively engage said sprocket.

3. The apparatus claimed in claim 1, further including a drive separator displacing said chain so that portions of said chain will not interfere with portions of said sprocket.

4. An apparatus for processing photosensitive materials, which comprises:

a tank through which a processing solution is to be pumped;

a rack having internal means to facilitate its insertion and removal from said tank, said rack and said tank are relatively dimensioned so that a small volume for holding processing solution and photosensitive material is formed between said rack and said tank;

means for circulating the processing solution through the small volume;

a first plurality of rollers for moving the photosensitive material into or out of the small volume;

a second plurality of rollers connected to said rack;

a third plurality of rollers connected to said tank, wherein said second and third plurality of rollers move the photosensitive material through the small volume;

a plurality of pulleys which are each individually coupled to one of said second plurality of rollers; and a timing belt coupled to said second plurality of rollers to drive each of said second plurality of rollers; and means for preventing processing solution from flowing between said pulleys, said timing belt and said second plurality for rollers to reduce the space that would otherwise be filled by the processing solution.

5. The apparatus claimed in claim 4, further including a drive engager positioned in the vicinity of said belt so that said chain will positively engage said pulley.

6. The apparatus claimed in claim 4, further including a drive separator displacing said belt so that portions of said belt will not interfere with portions of said pulley.

7. An apparatus for processing photosensitive materials, which comprises:

a tank through which a processing solution is to be pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume;

a first plurality of rollers for moving the photosensitive material into or out of the small volume;

a second plurality of rollers connected to said rack;

a third plurality of rollers connected to said tank, wherein said second and third plurality of rollers move the photosensitive material through the small volume;

a plurality of pulleys which are each individually coupled to one of said second plurality of rollers;

a belt coupled to said second plurality of rollers to drive each of said second plurality of rollers;

means for driving said second plurality of rollers; and means for preventing processing solution from flowing between said pulleys, said belt and said second plurality of rollers to reduce the space that would otherwise be filled by the processing solution.

8. The apparatus claimed in claim 7, further including a drive engager positioned in the vicinity of said belt so that said chain will positively engage said pulley.

9. The apparatus claimed in claim 7, further including a drive separator displacing said belt so that portions of said belt will not interfere with portions of said pulley.

10. An apparatus for processing photosensitive materials, which comprises:

a tank through which a processing solution is to be pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume;

a first plurality of rollers for moving the photosensitive material into or out of the small volume;

a second plurality of rollers connected to said rack;

a third plurality of rollers connected to said tank, wherein said second and third plurality of rollers move the photosensitive material through the small volume;

a plurality of interconnecting gears which are each individually coupled to one of said second plurality of rollers, wherein each of said gears cascades power to the next gear so that each one of said second plurality of rollers move; and means for preventing processing solution from flowing between said gears and said second plurality of rollers to reduce the space that would otherwise be filled by the processing solution.

11. An apparatus for processing photosensitive materials, which comprises:

a tank through which a processing solution is to be pumped;

a rack having integral means to facilitate its insertion and removal from said tank, said rack and said tank are relatively dimensioned so that a small volume for holding processing solution and photosensitive material is formed between said rack and said tank;

means for circulating the processing solution through the small volume;

a first plurality of rollers for moving the photosensitive material into or out of the small volume;

a second plurality of rollers connected to said rack;

a third plurality of rollers connected to said tank, wherein said second and third plurality of rollers move the photosensitive material through the small volume;

a first plurality of bevel gears each individually connected to each of said second plurality of rollers;

a second plurality of bevel gears engaging said first plurality of bevel gears;

a shaft connected to each of said second bevel gears so that rotation of said shaft causes said second plurality of rollers to rotate; and means for preventing processing solution from flowing between said first plurality of bevel gears, said second plurality of bevel gears, said shaft and said second plurality of rollers to reduce the space that would otherwise be filled by the processing solution.

12. The apparatus claimed in claim 11, wherein said preventing means comprises:

a fluid displacement plate having cut out areas which contain said driving means.

* * * * *

UNITED STATES PATENT AND TRADEMARK OFFICE

CERTIFICATE OF CORRECTION

PATENT NO. : 5,311,235
DATED : May 10, 1994
INVENTOR(S) : Piccinino, Jr., et. al.

It is certified that error appears in the above-indentified patent and that said Letters Patent is hereby corrected as shown below:

Column 1, line 18, delete "844,815" and insert --844,355--.

Signed and Sealed this

Thirtieth Day of August, 1994

Bruce Lehman

*Attest:*

BRUCE LEHMAN

*Attesting Officer*

*Commissioner of Patents and Trademarks*